US005617765A

United States Patent [19]

Bennett

[11] Patent Number: 5,617,765

[45] Date of Patent: Apr. 8, 1997

[54] JAR OPENER

[76] Inventor: Vivian A. Bennett, Rte. 3, Box 4032, Palatka, Fla. 32177

[21] Appl. No.: 497,870

[22] Filed: Jul. 3, 1995

[51] Int. Cl.[6] ..... B67B 7/00

[52] U.S. Cl. ..... 81/3.2; 81/3.32

[58] Field of Search ..... 81/3.2, 3.36, 3.37, 81/3.29, 3.39, 3.32, 3.4

[56] References Cited

U.S. PATENT DOCUMENTS

| | | | |
|---|---|---|---|
| 3,950,801 | 4/1976 | Morrison | 81/3.2 |
| 4,171,650 | 10/1979 | Cardinal | 81/3.2 |
| 5,167,172 | 12/1992 | Heebner | 81/3.2 |
| 5,207,125 | 5/1993 | Pierce, Jr. et al. | 81/3.39 |
| 5,271,296 | 12/1993 | Parent et al. | 81/3.2 |
| 5,370,019 | 12/1994 | Sartell et al. | 81/3.2 |

*Primary Examiner*—D. S. Meislin
*Assistant Examiner*—Joni B. Danganan

[57] ABSTRACT

A jar opener including a rigid housing having a horizontal top wall, a horizontal bottom wall, and a space therebetween and with the bottom wall further having a gripping surface for gripping a bottom of a jar that is placed thereupon; an elongated horizontal traveling plate disposed within the space at a location above the gripping surface of the bottom wall; a revolvable wheel coupled to the traveling plate at a location above the gripping surface of the bottom wall and with the wheel also having a gripping surface for gripping a lid on the jar; a first drive mechanism engaged with the traveling plate for allowing its lowering for placement of the gripping surface of the wheel in contact with a lid on the jar; and a second drive mechanism engaged with the wheel for allowing its revolution for loosening the lid on the jar.

1 Claim, 3 Drawing Sheets

JAR OPENER

BACKGROUND OF THE INVENTION

1. Field of the Invention

The present invention relates to a jar opener and more particularly pertains to automatically opening a lid on a jar with a jar opener.

2. Description of the Prior Art

The use of jar opening mechanisms is known in the prior art. More specifically, jar opening mechanisms heretofore devised and utilized for the purpose of opening a lid of a jar are known to consist basically of familiar, expected and obvious structural configurations, notwithstanding the myriad of designs encompassed by the crowded prior art which have been developed for the fulfillment of countless objectives and requirements.

By way of example, Des U.S. Pat. No. 249,324 to Hutson discloses a jar opener. U.S. Pat. No. 3,950,801 to Morrison discloses a combination jar and can opener. U.S. Pat. No. 4,082,016 to Vonusa discloses a lid remover. U.S. Pat. No. 4,102,226 to McGuire discloses a jar opening apparatus. U.S. Pat. No. 5,003,844 to Barrow discloses a portable container opener. U.S. Pat. No. 5,203,236 to Anderson discloses a lid starting apparatus and method. U.S. Pat. No. 5,207,125 to Pierce, Jr. et al. discloses an opener for screwed cap containers. U.S. Pat. No. 5,271,296 to Parent et al. discloses an automated container and method.

While these devices fulfill their respective, particular objective and requirements, the aforementioned patents do not describe a jar opener that includes a drive mechanism for lowering a gripping mechanism in contact with a lid on a jar and includes another drive mechanisms that allow a lid on a jar to be revolved.

In this respect, the jar opener according to the present invention substantially departs from the conventional concepts and designs of the prior art, and in doing so provides an apparatus primarily developed for the purpose of automatically opening a lid on a jar.

Therefore, it can be appreciated that there exists a continuing need for new and improved jar opener which can be used for automatically opening a lid on a jar. In this regard, the present invention substantially fulfills this need.

SUMMARY OF THE INVENTION

In the view of the foregoing disadvantages inherent in the known types of jar opening mechanisms now present in the prior art, the present invention provides an improved jar opener. As such, the general purpose of the present invention, which will be described subsequently in greater detail, is to provide a new and improved jar opener and method which has all the advantages of the prior art and none of the disadvantages.

To attain this, the present invention essentially comprises, in combination, a rigid and generally box-shaped housing. The housing includes a central axis disposed therethrough, a horizontal top wall, a horizontal bottom wall, and a first pair and a second pair of opposed side walls extended therebetween to define a hollow interior. Each wall of the housing further has an interior surface and an exterior surface. Each side wall of the first pair of the housing also has a generally square window formed thereon for allowing access to the interior. The bottom wall of the housing further has a centrally located rigid platform extended upwards from its interior surface. The platform additionally has a gripping surface thereon for gripping a bottom of a jar that is placed thereupon.

A first electric motor is included and has a fixed stator coupled to the platform and a rotatable rotor having two ends extended outwards from the stator toward the second pair of side walls. Each end of the rotor is terminated with a bevel gear. An elongated horizontal traveling plate is included and disposed within the interior at a location above the platform. The traveling plate has an upper surface, a lower surface, a central portion aligned with the central axis of the housing, and a pair of arms extended diametrically outwards from the central portion. Each arm of the plate has a threaded through hole formed thereon. A pair of opposed, rigid, and axially rotatable vertical shafts are also provided. Each shaft has a central axis, an upper end coupled to the interior surface of the top wall, a lower end terminated with a bevel gear. The bevel gear of each shaft is positioned in mesh with one of the bevel gears of the first motor. Each shaft also has an intermediate threaded portion extended between the ends thereof and disposed within one of the through holes of the traveling plate. Rotation of the shafts allows the traveling plate to be raised and lowered.

An axially revolvable wheel is included. The wheel is aligned with the central axis of the housing and coupled to the central portion of the traveling plate. The wheel includes a shaft, a disc coupled to the shaft and positioned directly above the gripping surface of the platform, and a gear secured about the shaft. The disc additionally has a gripping surface with a plurality of concentrically positioned rings of gripping teeth formed thereon for gripping a lid on the jar. A second electric motor is included. The second motor has a fixed stator coupled to the traveling plate and a rotatable rotor with a gear formed thereon. The gear of the second motor is positioned in mesh with the gear on the wheel.

A sheathed power cable is used for supplying electrical power. The power cable has a proximal end extended within the housing and a distal plug end removably securable to an external electrical power source. A manually operated first switch is provided. The first switch has a terminal portion coupled between the proximal end of the power cable and the stator of the first motor and a toggleable portion extended from the housing. The first switch has a first orientation that energizes the first motor to axially rotate the shafts in one direction to raise the traveling plate, a second orientation that energizes the first motor to axially rotate the shafts in an opposite direction to lower the traveling plate to a location such that the gripping surface of the wheel is in contact with the lid on the jar that is placed upon the gripping surface of the platform, and a third orientation that deenergizes the first motor and prevents traveling plate movement. Lastly, a manually operated second switch is included. The second switch has a terminal portion coupled between the proximal end of the power cable and the stator of the second motor and a toggleable portion extended from the housing. The second switch has a first orientation that energizes the second motor to revolve the wheel in one direction to allow the lid positioned in contact with the gripping surfaces to be loosened, a second orientation that energizes the second motor to revolve the wheel in another direction to allow the lid positioned in contact with the gripping surfaces to be tightened, and a third orientation that deenergizes the second motor to thereby stop wheel movement.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved jar opener which has all the advantages of the prior art jar opening mechanisms and none of the disadvantages.

It is another object of the present invention to provide a new and improved jar opener which may be easily and efficiently manufactured and marketed.

It is a further object of the present invention to provide a new and improved jar opener which is of durable and reliable construction.

An even further object of the present invention is to provide a new and improved jar opener which is susceptible of a low cost of manufacture with regard to both materials and labor, and which accordingly is then susceptible of low prices of sale to the consuming public, thereby making such a jar opener economically available to the buying public.

Still yet another object of the present invention is to provide a new and improved jar opener which provides in the apparatuses and methods of the prior art some of the advantages thereof, while simultaneously overcoming some of the disadvantages normally associated therewith.

Even still another object of the present invention is to provide a new and improved jar opener for automatically opening a lid on a jar.

Lastly, it is an object of the present invention to provide a new and improved jar opener comprising a rigid housing including a horizontal top wall, a horizontal bottom wall, and a space therebetween and with the bottom wall having a gripping surface for gripping a bottom of a jar that is placed thereupon; an elongated horizontal traveling plate disposed within the space at a location above the gripping surface of the bottom wall; a revolvable wheel coupled to the traveling plate at a location above the gripping surface of the bottom wall and with the wheel also having a gripping surface for gripping a lid on the jar; first drive means engaged with the traveling plate for allowing its lowering for placement of the gripping surface of the wheel in contact with a lid on the jar; and second drive means engaged with the wheel for allowing its revolution for loosening the lid on the jar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
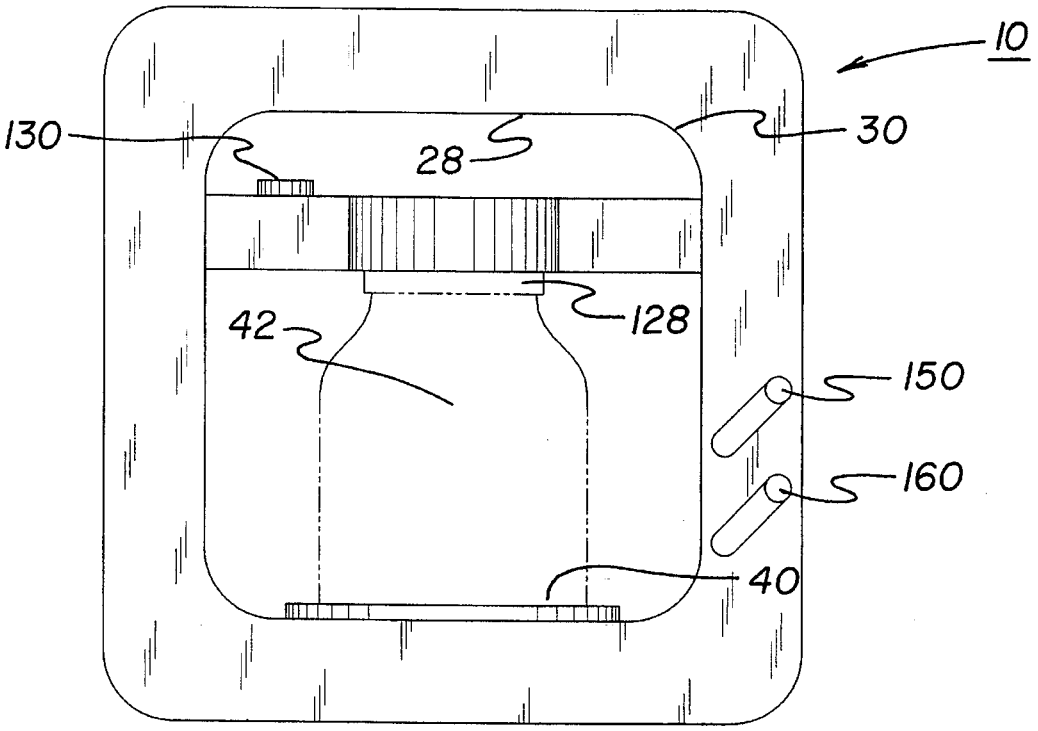
FIG. 1 is a side elevational view of the preferred embodiment constructed in accordance with the principles of the present invention engaged with a jar.
Figure 2:
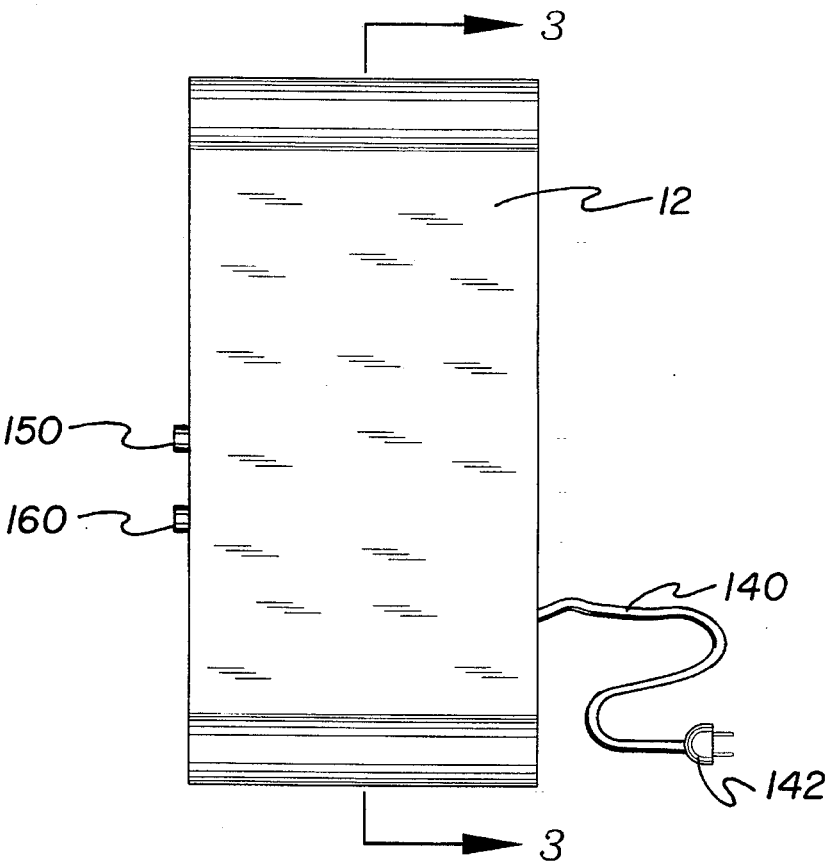
FIG. 2 is a plan view of the preferred embodiment of the present invention.
Figure 3:
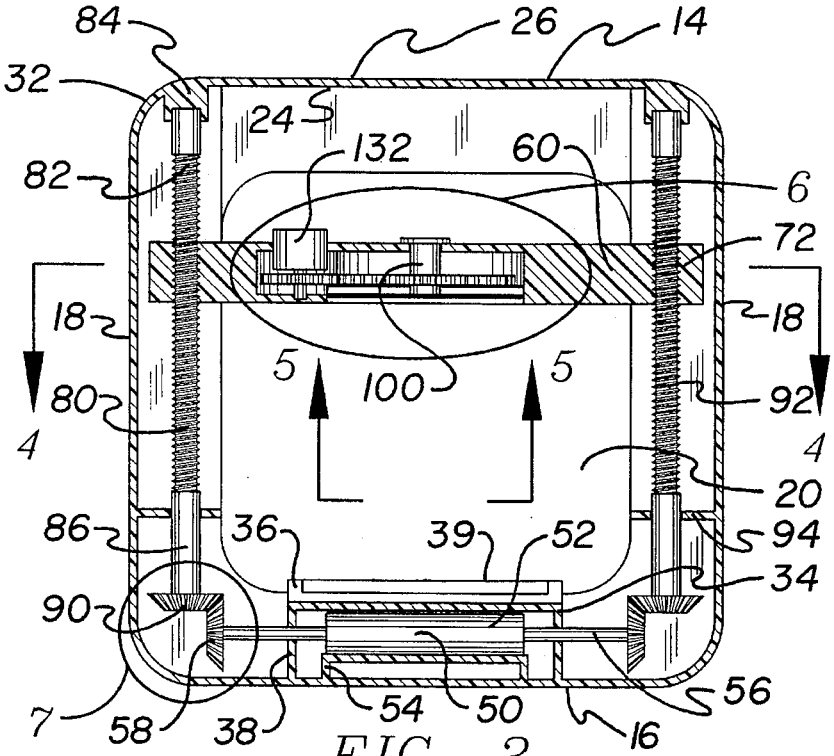
FIG. 3 is a cross-sectional view of the present invention take along the line 3—3 of FIG. 2.
Figure 4:
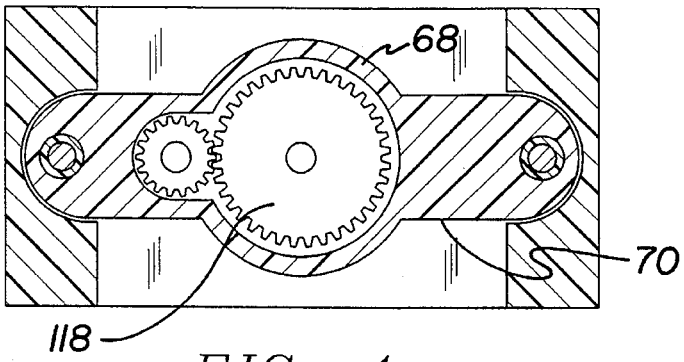
FIG. 4 is a view of the present invention taken along the line 4—4 of FIG. 3.
Figure 5:
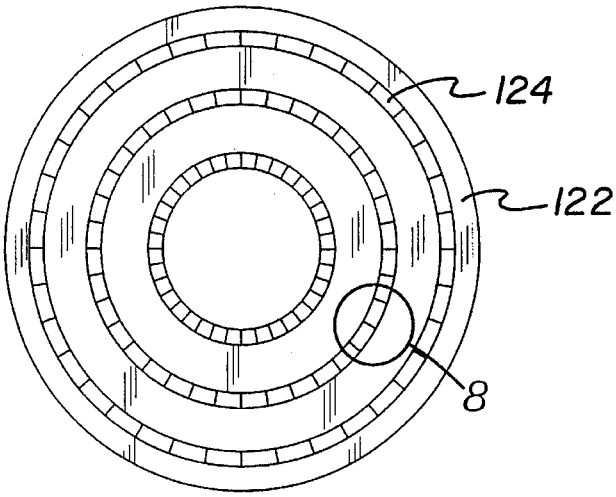
FIG. 5 is a view of the present invention taken along the line 5—5 of FIG. 3.
Figure 6:
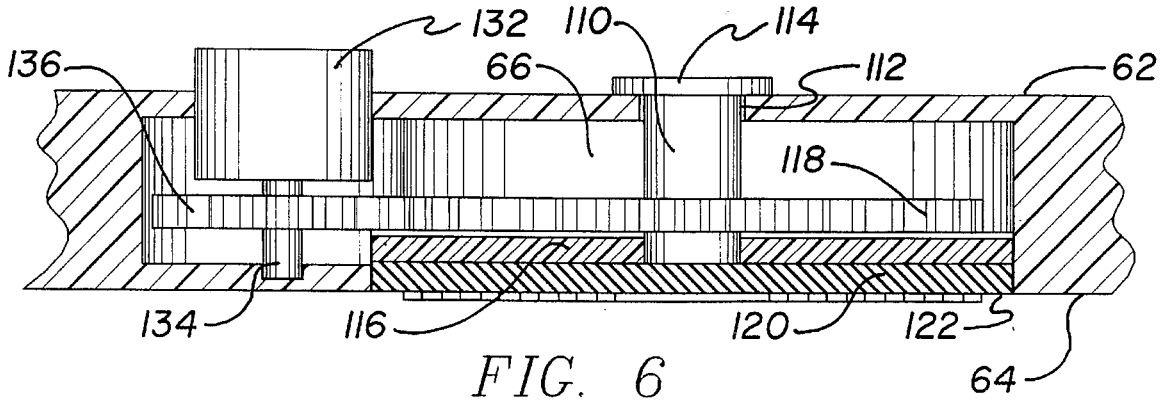
FIG. 6 is an enlarged cross-sectional view of the engagement of the second motor with the wheel of the present invention.
Figure 7:
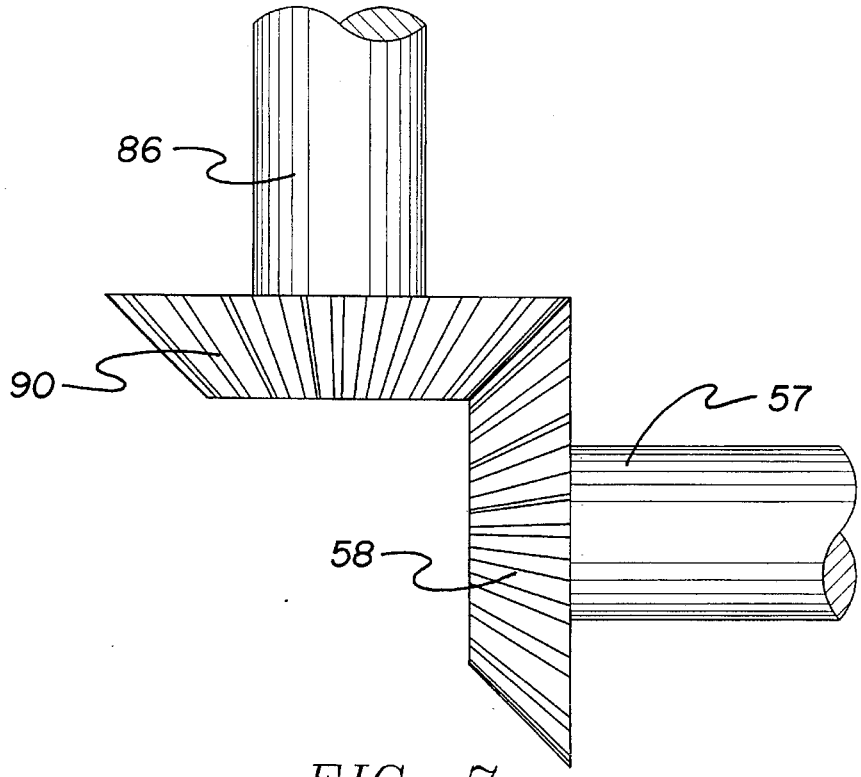
FIG. 7 is an enlarged view of the engagement of one of the bevel gears of the first motor with one of the bevel gears of one of the shafts.
Figure 8:
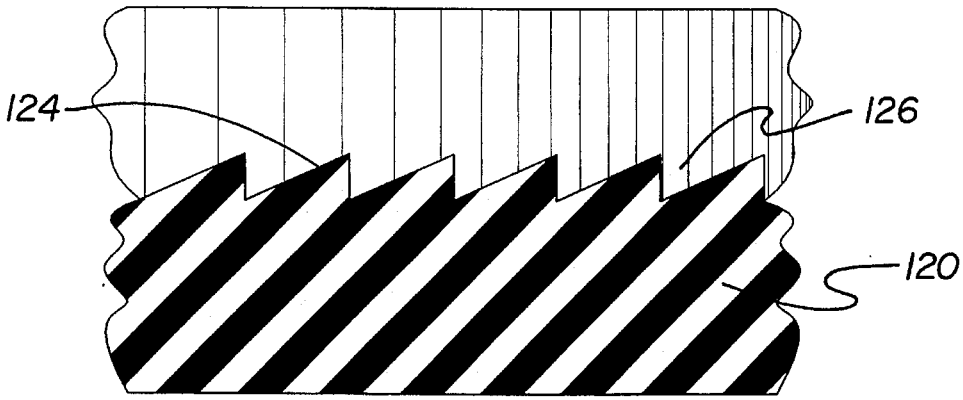
FIG. 8 is an enlarged side elevational view of the gripping surface formed on the wheel of the present invention.

With reference now to the drawings, and in particular, to FIG. 1 thereof, the preferred embodiment of the new and improved jar opener embodying the principles and concepts of the present invention and generally designated by the reference number 10 will be described.

The preferred embodiment of the present invention comprises a plurality of components. In their broadest context, such components include a housing, a pair of motors, a traveling plate, a pair of shafts, a wheel, a power cable, and a pair of switches. Such components are individually configured and correlated with respect to each other to provide a structure that allows a jar secured with a lid to be readily opened.

Specifically, the present invention includes a housing 12. The housing is generally box-shaped in structure. It is formed of rigid material such as metal or plastic. The housing has a central axis disposed therethrough, a horizontal top wall 14, a horizontal bottom wall, and a first pair and a second pair of opposed side walls 18. The side walls are extended between the top wall 14 and the bottom wall 16 to define a hollow interior 20. Each wall of the housing has an interior surface 24 and an exterior surface 26. Each side wall of the first pair has a generally square window 28 with rounded corners 30 formed thereon. The windows allow access to the interior 20. The side walls of the second pair are interconnected with the top wall 14 and the bottom wall 16 to form an upper pair and a lower pair of rounded corners 32. The bottom wall has a centrally located and rigid platform 34 extended upwards from its interior surface 24. The platform includes a horizontal top wall 36 supported by a peripheral border 38. The top wall 36 has a recessed area with a layer of rubber secured therein. The upper surface of the layer of rubber 38 provides a gripping surface 39 for gripping a bottom 40 of a jar 42 that is placed thereupon.

A first electric motor 50 is provided. The motor has a fixed stator 52 disposed under the top wall 36 of the platform 34. The stator is coupled to a step 54 which is included as part of the platform 34. The first electric motor includes an elongated, rigid, and rotatable rotor 56. The rotor 56 has two ends 57 extended outwards from the stator 52 and through holes formed on the border 38. The ends 57 are directed toward the second pair of side walls 18 of the housing. Each end of the stator 52 is terminated with a bevel gear 58. The stator 52 imparts rotation to the rotor 56 when electrically energized.

Disposed within the interior 20 of the housing at a location above the platform 34 is a traveling plate 60. The traveling plate is elongated and positioned in a horizontal plane. The traveling plate is formed of a rigid material such as metal or plastic. The traveling plate has an upper surface 62 and a lower surface with a recessed portion 66 formed thereon. The traveling plate also has a generally circular central portion 68 aligned with the central axis of the housing. In addition, a pair of arms 70 is coupled to the central portion 68 of the traveling plate in a diametrical fashion. Each arm is terminated at a generally rounded end. Each rounded end has a threaded through hole 72 formed thereon.

A pair of opposed rigid and axially rotatable shafts 80 are included. The shafts are positioned vertically. Each shaft has a central axis, an upper end 82 coupled to the interior surface 24 of the top wall with a seat 84, and a lower end 86 terminated with a bevel gear 90. The bevel gear 90 is positioned in mesh with one of the bevel gears 58 of the first motor 50. Furthermore, an intermediate threaded portion 92 is extended between the ends 82, 86. The threaded portion is further disposed within one of the through holes 72 of the traveling plate and through a guide 94 extended outwards from the interior surface of one of the side walls of the second pair. Rotation of the shafts 80 allow the traveling plate 60 to be raised or lowered.

An axially revolvable wheel 100 is disposed within the recessed portion 66 of the traveling plate and aligned with the central axis of the housing 12. The wheel 100 is coupled to the central portion 68 of the traveling plate. The wheel includes a cylindrical shaft 110 extended within a through hole 112 formed on the traveling plate 60 and is terminated with a flange 114. A disk 116 is coupled to the other end of the shaft directly above the gripping surface 39 formed by the layer of rubber 38 on the platform 34. A gear 118 is secured about the shaft 110 between the flange 114 and disk 116. The disk 116 also includes a layer of rubber 120 secured thereto. The upper surface of the layer of rubber provides another gripping surface 122. The gripping surface 122 on the wheel 100 is positioned in coplanar alignment with the lower surface 64 of the traveling plate 60. In addition, a plurality of concentric and downwardly extending rings 124 of rubber gripping teeth 126 are formed on the gripping surface 122. The teeth 126 allow a firm grip of a lid 128 on the jar 42.

A second electric motor 130 is also provided. The second motor has a fixed stator 132 coupled to the traveling plate 60. The motor 130 also has a rotatable rotor 134 with a gear 136 formed thereon. Gear 136 is positioned in mesh with the gear 118 on the wheel 100. The stator 132 imparts rotation to the rotor 134 when electrically energized.

To supply electrical power to the motors 50 and 130, a sheathed power cable 140 is included. The power cable 140 has a proximal end extended within the housing. The power cable also has a distal plug end 142. Plug end 142 is removably securable to an external electrical power source. Conventionally, the interface to this power source is through an electrical receptacle of a common household electrical power network.

A manually operated three position first switch 150 is used for controlling the first motor 50. The switch 150 has a terminal portion coupled between the proximal end of the power cable 140 and the stator 52 of the first motor. The first switch also includes a toggleable portion extended from the housing 12 for actuation by a user. The first switch 150 has a first orientation that energizes the first motor 50 to axially rotate the shafts 80 in one direction to raise the traveling plate 60. The first switch also has a second orientation that energizes the first motor to axially rotate the shafts 80 in an opposite direction to lower the traveling plate 60 to a location such that the gripping surface 122 of the wheel 100 is in contact with the lid 128 on the jar 42 when the jar is placed upon the gripping surface 39 of the platform 34. The first switch also has a third orientation that deenergizes the first motor and prevents traveling plate movement.

Lastly, a manually operated three position second switch 160 is used for controlling the second motor 130. The second switch 160 has a terminal portion coupled between the proximal end of the power cable 140 and the stator 132 of the second motor. In addition, the second switch includes a toggleable portion extended from the housing for allowing its actuation by the user. The second switch has a first orientation that energizes the second motor 130 to revolve the wheel 100 in one direction to thereby allow the lid 128 that is positioned in contact with the gripping surfaces 39, 122 to be loosened. The second switch also has a second orientation that energizes the second motor to revolve the wheel in another direction to allow the lid 128 that is positioned in contact with the gripping surfaces to be tightened. The second switch also has a third orientation that deenergizes the second motor to stop wheel movement.

The present invention is a device which automatically opens jars of different sizes. The present invention is useful in both a household and commercial setting. The housing of the present invention has a height of about 12 inches, a length of about 8 inches, and a width of about 6 inches. Instead of using electrical power supplied through the power cable, the present invention can be outfitted with a battery to allow its portable use as well as use in areas where commercially available electricity is not available.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A jar opener comprising, in combination:

a rigid and generally box-shaped housing including a central axis disposed therethrough, a horizontal top wall, a horizontal bottom wall, a first pair and a second pair of opposed side walls extended therebetween to define a hollow interior, each wall further having an interior surface and an exterior surface, each side wall of the first pair further having a generally square window with round corners formed thereon for allowing access to the interior, the bottom wall further having a centrally located rigid platform extended upwards from its interior surface with the platform including a top horizontal top wall supported by a peripheral border, a recessed area, and additionally having a gripping surface for gripping a bottom of a jar that is placed within the recessed area;

a first electric motor having a fixed stator coupled to the platform and a rotatable, elongated, and rigid rotor having two ends extended outwards from the stator toward the side walls of the second pair and through the border and with each end thereof terminated with a bevel gear;

an elongated horizontal traveling plate disposed within the interior at a location above the platform, the traveling plate having an upper surface, a lower surface, a central portion aligned with the central axis of the housing, and a pair of arms extended diametrically outwards from the central portion and with each arm further having a rounded end and a threaded through hole formed thereon;

a pair of opposed rigid axially rotatable vertical shafts with each shaft having a central axis, an upper end coupled to the interior surface of the top wall with a seat, a lower end terminated with a bevel gear that is positioned in mesh with one of the bevel gears of the first motor, and an intermediate threaded portion extended between the ends and disposed within one of the through holes of the traveling plate and with rotation of the shafts allowing the traveling plate to be raised and lowered;

an axially revolvable wheel aligned with the central axis of the housing and coupled to the central portion of the traveling plate, the wheel including a cylindrical shaft extended within a through hole formed on the traveling plate and terminated at a flange, a planar disc coupled to the shaft on an end opposite the flange and positioned directly above the gripping surface of the platform, and a gear secured about the shaft between the flange and disk and with the planar disc additionally having a thin gripping surface coupled thereto with a plurality of concentrically positioned rings of gripping teeth formed thereon for gripping a lid on the jar, the rings positioned in alignment with the lower surface of the traveling plate;

a second electric motor having a fixed stator coupled to the traveling plate and a rotatable rotor with a gear formed thereon positioned in mesh with the gear on the wheel;

a sheathed power cable for supplying electrical power having a proximal end extended within the housing and a distal plug end removably securable to an external electrical power source;

a manually operated first switch having a terminal portion coupled between the proximal end of the power cable and the stator of the first motor and a toggleable portion extended from the housing and with the first switch having a first orientation that energizes the first motor to axially rotate the shafts in one direction to raise the traveling plate, a second orientation that energizes the first motor to axially rotate the shafts in an opposite direction to lower the traveling plate to a location such that the gripping surface of the wheel is in contact with the lid on the jar that is placed upon the gripping surface of the platform, and a third orientation that deenergizes the first motor and prevents traveling plate movement; and a manually operated second switch having a terminal portion coupled between the proximal end of the power cable and the stator of the second motor and a toggleable portion extended from the housing and with the second switch having a first orientation that energizes the second motor to revolve the wheel in one direction to allow the lid positioned in contact with the gripping surfaces to be loosened, a second orientation that energizes the second motor to revolve the wheel in another direction to allow the lid positioned in contact with the gripping surfaces to be tightened, and a third orientation that deenergizes the second motor to thereby stop wheel movement.

* * * * *